US006622597B2

(12) United States Patent
Chen

(10) Patent No.: US 6,622,597 B2
(45) Date of Patent: Sep. 23, 2003

(54) RATCHEL TOOL HAVING LONGITUDINALLY MOVABLE PAWLS

(76) Inventor: Su Shia Chen, 1F, No. 23, Bien Hsin Lane, Wu Zh Hsiang, Taichung Hsien (TW), 414

( * ) Notice: Subject to any disclaimer, the term of this patent is extended or adjusted under 35 U.S.C. 154(b) by 0 days.

(21) Appl. No.: 09/859,308

(22) Filed: May 18, 2001

(65) Prior Publication Data

US 2002/0170392 A1 Nov. 21, 2002

(51) Int. Cl.[7] ..... B25B 13/00
(52) U.S. Cl. ..... 81/58.3; 81/60; 81/438
(58) Field of Search ..... 81/58, 58.3, 438, 81/60

(56) References Cited

U.S. PATENT DOCUMENTS 2,989,881 A * 6/1961 Lavietes ..... 81/63.2
3,136,346 A * 6/1964 Karl et al. ..... 81/58.3
3,799,226 A * 3/1974 Lavietes ..... 81/63.2
4,692,073 A * 9/1987 Martindell ..... 81/438
4,799,407 A * 1/1989 Miyamoto ..... 81/58.3
5,687,820 A 11/1997 Lin ..... 192/43.2
5,570,616 A 8/1998 Thompson et al. ..... 81/63.1
6,047,802 A 4/2000 Huang ..... 192/43.2
6,058,812 A * 5/2000 Casel et al. ..... 81/60

* cited by examiner

*Primary Examiner*—James G. Smith
(74) *Attorney, Agent, or Firm*—Charles E. Baxley

(57) ABSTRACT

A ratchet tool includes a seat rotatably secured to a housing and having a number of teeth facing toward the housing, the housing having two channels for slidably receiving two pawls which are biased to engage with the teeth of the seat, and an actuator rotated by a control ferrule to selectively disengage the pawls from the teeth of the seat to control the rotational direction of the seat by the housing. A driving stem is engaged in the seat and has an engaging hole for changeably receiving a tool member. A rod may be biased to secure the tool member to the driving stem.

12 Claims, 4 Drawing Sheets

RATCHEL TOOL HAVING LONGITUDINALLY MOVABLE PAWLS

The present invention relates to U.S. patent application Ser. No. 09/716,157, filed Nov. 20, 2000.

BACKGROUND OF THE INVENTION

1. Field of the Invention

The present invention relates to a tool, and more particularly to a ratchet tool.

2. Description of the Prior Art

Various kinds of typical ratchet tools, particularly the ratchet screw drivers, have been developed and widely used today. U.S. Pat. No. 5,570,616 to Thompson et al., U.S. Pat. No. 5,687,820 to Lin, and U.S. Pat. No. 6,047,802 to Huang disclose three of the typical ratchet screw drivers and each includes a rotatable gear or a rotatable internal gear, and each includes a pair of pawls moved radially or laterally toward the gear or internal gear to control the operation directions of the ratchet screw drivers. The engagement between the radially or laterally moved pawls and the gear or internal gear is weak and may not sustain a great rotational driving torque. In addition, the driving stems or the driving tool members of the typical ratchet driving tools may not be changed or replaced with each other.

The present invention has arisen to mitigate and/or obviate the afore-described disadvantages of the conventional ratchet tools.

SUMMARY OF THE INVENTION

The primary objective of the present invention is to provide a ratchet tool including one or more pawls that may be moved longitudinally and that may be snugly engaged with the peripheral gear in order to increase the rotational driving torque to the driven fasteners.

The other objective of the present invention is to provide a ratchet tool including one or more driving stems that may be changed or replaced with each other for facilitating the operation of the ratchet tool.

In accordance with one aspect of the invention, there is provided a ratchet tool comprising a housing including a pair of longitudinal channels, a seat rotatably secured to the housing and including a first end facing toward the housing and having a plurality of teeth, the seat including a cylindrical member having an aperture for receiving a driving stem which has an engaging hole for receiving a tool member, means for detachably securing the tool member to the driving stem, a pair of pawls slidably engaged in the longitudinal channels of the housing respectively, means for biasing the pawls to move longitudinally relative to the housing to engage with the teeth of the seat, and means for selectively disengaging the pawls from the teeth of the seat to control a rotational direction of the seat by the housing.

The seat includes an orifice formed in the first end thereof, the housing includes a barrel rotatably secured in the orifice of the seat.

The housing includes an outer peripheral portion having a passageway communicating with the channels of the housing, the selectively disengaging means includes an actuator slidably received in the passageway of the housing and rotatable to engage with either of the pawls.

The pawls each includes a notch, the actuator includes two ends engageable into the notches of the pawls.

The ends of the actuator each includes an inclined surface for facilitating an engagement of the ends of the actuator into the notches of the pawls.

The selectively disengaging means includes a control ferrule rotatably secured on the housing and having the actuator secured thereto for moving the actuator along the passageway of the housing.

The selectively disengaging means includes a fastener for securing the actuator to the control ferrule and for allowing the actuator to be rotated by the control ferrule.

A device is further for selectively securing the control ferrule to the housing at a selected angular position, and includes three depressions formed in the control ferrule, and a spring-biased projection engaged in the housing and selectively biased to engage with either of the depressions of the control ferrule.

The detachably securing means includes a guide passage formed in the driving stem and communicating with the engaging hole of the driving stem, a rod slidably received in the guide passage of the driving stem, and a rod biasing means for biasing the rod to move inward of the engaging hole of the driving stem and to engage with the tool member, for detachably securing the tool member to the driving stem.

The rod biasing means includes a spring engaged on the driving stem and engaged with the rod for biasing the rod to engage with the tool member. A ring is engaged between the rod and the spring for evenly forcing the rod to engage with the tool member.

The rod biasing means further includes an actuating sleeve engaged on the driving stem and having a peripheral shoulder provided therein for engaging with the rod and for moving the rod inward of the engaging hole of the driving stem.

The rod biasing means further includes a cap engaged on the driving stem and secured to the actuating sleeve and engaged with the spring for retaining the spring within the actuating sleeve.

The guide passage of the driving stem is inclined from a radially outer portion of the driving stem to a radially inward portion of the driving stem and communicating with the engaging hole of the driving stem for slidably receiving the rod.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
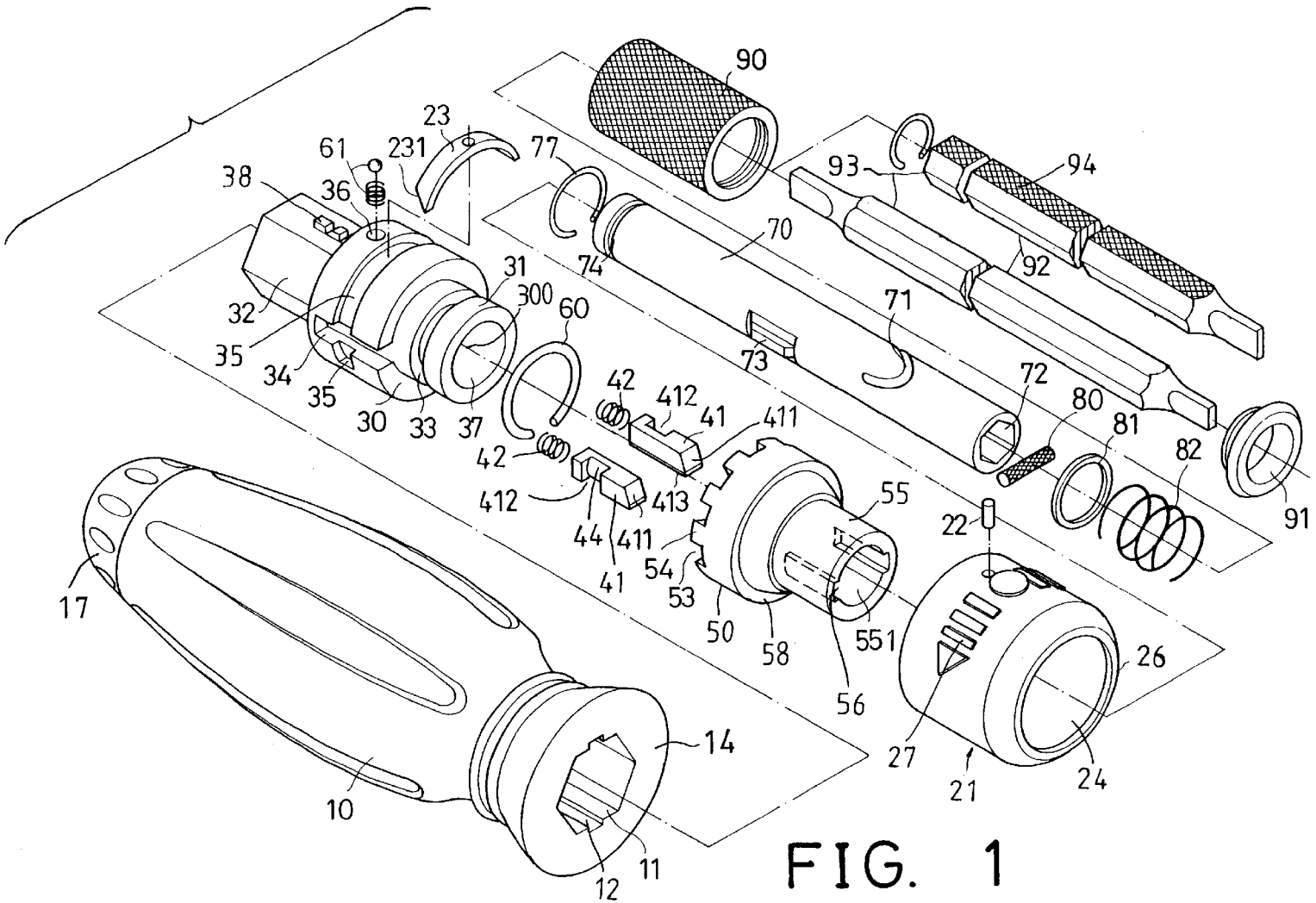
FIG. 1 is an exploded view of a ratchet tool in accordance with the present invention.

Referring to the drawings, and initially to FIGS. 1–5, a ratchet tool in accordance with the present invention comprises a handle 10 including a hole 11 and one or more slots 12 formed in one end thereof and communicating with each other and including a flat surface 14 formed in the end thereof. A ratchet housing 30 is engaged with the flat surface 14 of the handle 10 and includes a bore 37 formed therein and includes an extension 32 extended from one end thereof and engaged into the hole 11 of the handle 10 and secured to the handle 10 with such as a force-fitted engagement. The extension 32 and the mating hole 11 of the housing 10 include a mating non-circular cross section for allowing the housing 30 to be rotated in concert with the handle 10 and for allowing the housing 30 to be driven or rotated by the handle 10. The extension 32 of the housing 30 may further be secured to the handle 10 with one or more keys 38. The housing 30 and the handle 10 may also be formed as a one-integral-piece structure, or the housing 30 may include the handle 10 extended from the housing 30. The housing 30 includes a barrel 31 extended from the other end thereof and having an outer diameter smaller than that of the housing 30 and having a peripheral groove 33 formed in the outer peripheral portion thereof for receiving a retaining ring 60 therein.

Figure 5:
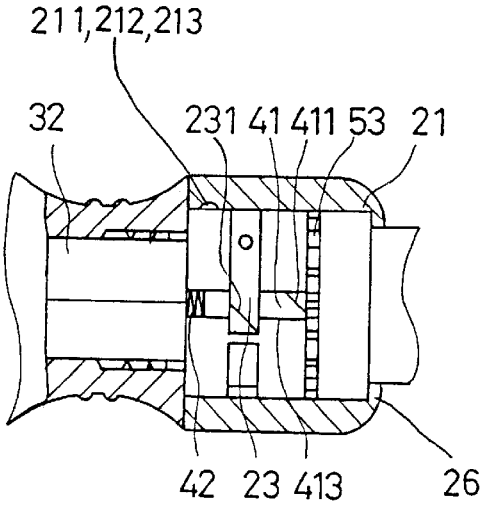
FIG. 5 is a partial cross sectional view similar to FIG. 3, illustrating the operation of the ratchet tool.
Figure 2:
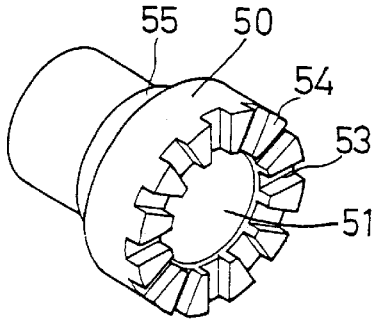
FIG. 2 is a perspective view of a seat viewing from an opposite direction from that shown in FIG. 1.

The housing 30 includes one or more, particularly two channels 34, formed in the outer peripheral portion thereof and parallel to the longitudinal axis 300 of the housing 30, for slidably receiving one or more springs 42 and pawls 41 therein respectively. The housing 30 includes a passageway 35 formed in the outer peripheral portion thereof and communicating with the channels 34 thereof, and includes a hole 36 formed in the outer peripheral portion thereof for receiving a spring-biased projection 61 therein. The pawls 41 each includes a flat surface 413 formed in one side thereof and an inclined surface 411 formed in the other side thereof opposite to the flat surface 413, and each includes a notch 412 formed therein for communicating with the passageway 35 of the housing 30, and each includes a curved bulge 44 formed or convex into the notch 412 thereof. An actuator 23 is slidably received in the passageway 35 of the housing 30 and includes two inclined ends or includes two ends each having an inclined surface 231 formed therein for engaging with the pawls 41 and for moving the pawls 41 against the springs 42 respectively (FIGS. 3, 5).

A control ferrule 21 includes a chamber 24 formed therein for rotatably receiving the housing 30 and includes a peripheral flange 26 extended radially inward of the chamber 24 from one end thereof. A fastener or a rivet or a fastener pin 22 is engaged through the control ferrule 21 and the actuator 23 for securing the actuator 23 to the control ferrule 21 and for allowing the actuator 23 to be moved by the control ferrule 21 to move along the passageway 35 of the housing 30 and to be engaged with the pawls 41. The control ferrule 21 may also be rotatably secured to the housing 30 with the sliding engagement of the actuator 23 in the passageway 35 of the housing 30. The control ferrule 21 includes three depressions 211, 212, 213 formed therein (FIGS. 3–5) for receiving the spring-biased projection 61 which may position and secure the control ferrule 21 to the housing 30 at the required angular position. The control ferrule 21 includes a pattern or one or more arrows 27 or the like provided on the outer peripheral portion for decoration purposes and/or for indicating the rotational direction of the control ferrule 21 relative to the housing.

A rotary seat 50 is rotatably received in the chamber 24 of the control ferrule 21 and includes a peripheral shoulder 58 formed therein for engaging with the peripheral flange 26 of the control ferrule 21 and for rotatably retaining the seat 50 in the control ferrule 21 and for preventing the seat 50 from being disengaged from the control ferrule 21. The seat 50 includes an orifice 51 (FIGS. 2, 3) formed therein for rotatably receiving the barrel 31 of the housing 30 and includes an annular recess 52 (FIG. 3) formed therein for receiving the retaining ring 60 which may rotatably secure the seat 50 to the barrel 31 of the housing 30. The seat 50 includes one end having a number of teeth 54 formed on the peripheral portion thereof and formed or defined between a number of cavities 53 (FIG. 2) of the seat 50. The pawls 41 may be biased by the springs 42 to engage with the teeth 54 of the seat 50.

Figure 3:
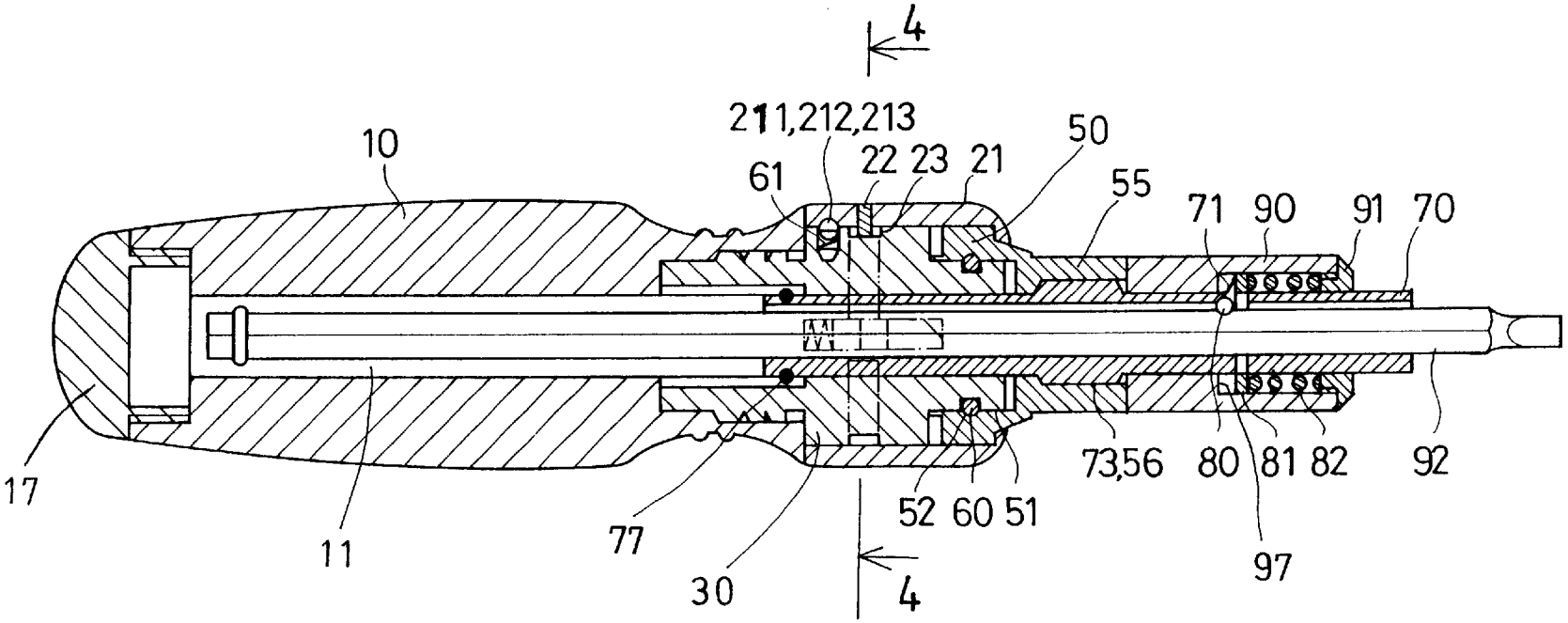
FIG. 3 is a cross sectional view taken along lines 3—3 of FIG. 4.

As shown in dotted lines in FIG. 3, when the pawls 41 are biased to engage with the teeth 54 of the seat 50, the notch 412 of the pawl 41 is partially communicating with the passageway 35 of the housing 30 or aligned with actuator 23 for allowing the inclined ends 231 of the actuator 23 to be engaged into the notches 412 of the pawls 41 and to move and disengage the pawls 41 from the teeth 54 of the seat 50. Accordingly, the pawls 41 may be actuated and moved to engage with or disengage from the teeth 54 of the seat 50 by the actuator 23. The control ferrule 21 may rotate the actuator 23 along the passageway 35 of the housing 30 to engage with either of the pawls 41.

The seat 50 includes a cylindrical member 55 extended therefrom and opposite to the teeth 54, and having an aperture 551 formed therein for receiving a driving stem 70 therein, and having one or more grooves 56 longitudinally formed therein and communicating with the aperture 551 of the seat 50. The aperture 551 and the orifice 51 of the seat 50 are communicated with each other (FIG. 3) for receiving the driving stem 70 therein. The driving stem 70 may also extend through the bore 37 of the housing 30 and extend into the hole 11 of the handle 10. The driving stem 70 includes one or more projections 73 laterally extended therefrom and engaged into the grooves 56 of the cylindrical member 55 for detachably securing the driving stem 70 to the seat 50.

Figure 4:
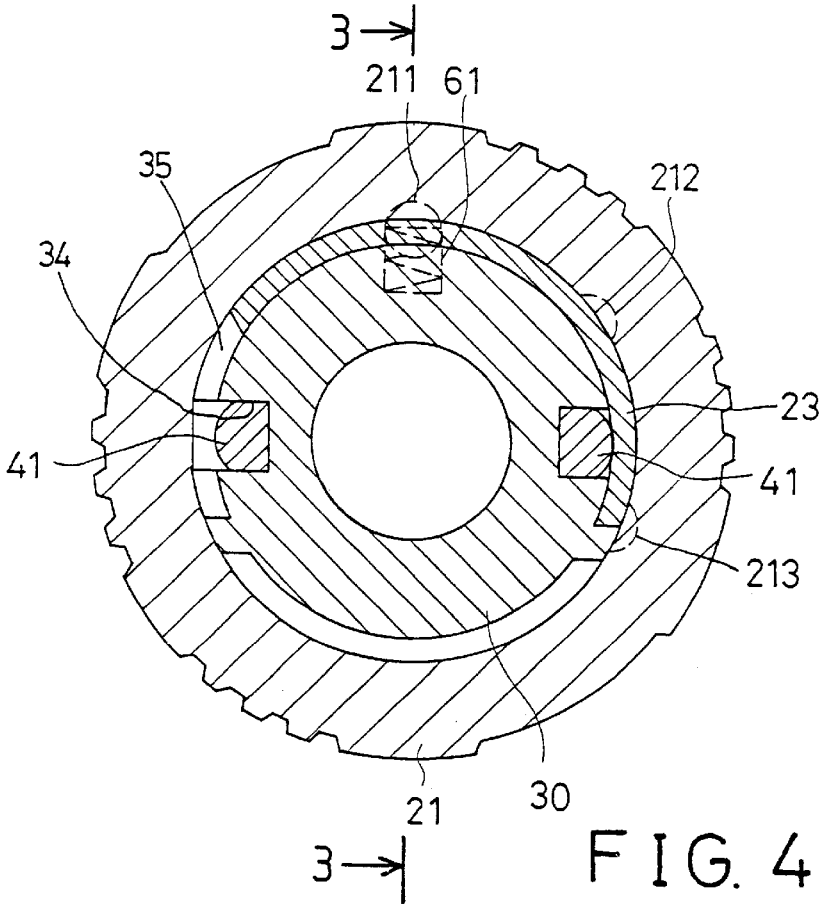
FIG. 4 is a cross sectional view taken along lines 4—4 of FIG. 3.

In operation, the pawls 41 may be biased by the springs 42 to engage with the teeth 54 of the seat 50. As shown in FIG. 4, the actuator 23 is secured to the control ferrule 21 and may be rotated to move along the passageway 35 of the housing 30. The ends of the actuator 23 may thus be moved to engage with the pawls 41 and to move the pawls 41 toward and away from the seat 50. When the control ferrule 21 is rotated to have the spring-biased projection 61 engaged in the middle depression 212 (FIG. 4) of the control ferrule 21, the ends of the actuator 23 may be disengaged from the pawls 41, such that the pawls 41 may both be biased to engage with the teeth 54 of the seat 50. At this moment, the seat 50 is solidly secured to the housing 30 with the pawls 41 such that the seat 50 and thus the driving stem 70 may be driven and rotated in both directions by the handle 10 via the housing 30.

As best shown in FIG. 4, when the actuator 23 is rotated relative to the housing 30 and when either of the ends of the actuator 23 is actuated to engage with the pawls 41, one of the pawls 41 may be disengaged from the teeth 54 of the seat 50 by the actuator 23 (FIG. 5) and the other pawl 41 may still be biased to engage with the teeth 54 of the seat 50. When only one of the pawls 41 is engaged with the teeth 54 of the seat 50, and when the teeth 54 of the seat 50 is rotated or forced to engage with the flat surface 413 of the pawl 41, the pawl 41 will not be disengaged from the seat 50 such that the seat 50 and thus the driving stem 70 may be driven and rotated in an active direction by the handle 10 via the housing 30 and the pawl 41. When the housing 30 is rotated in a reverse direction relative to the seat 50, the teeth 54 of the seat 50 may be caused to engage with the inclined surface 411 of the pawl 41 and may force the pawl 41 to move away from the teeth 54 of the seat 50 against the spring 42, such that the housing 30 may rotate freely relative to the seat 50 in the reverse direction and such that the seat 50 and the driving stem 70 will not be driven or rotated in the reverse direction by the handle 10 and the housing 30.

It is to be noted that the pawls 41 are slidably received in the longitudinal channels 34 of the housing 30 and may be moved longitudinally to engage with the teeth 54 of the seat 50. The engagement area between the pawls 41 and the teeth 54 of the seat 50 may be relatively increased as compared with that of the typical ratchet tools, such that the pawls 41 may be solidly engaged with the teeth 54 of the seat 50. The above-identified configuration of the ratchet tool has been disclosed in U.S. patent application Ser. No. 09/716,157, filed Nov. 20, 2000, which is taken as a reference for the present invention.

Figure 6:
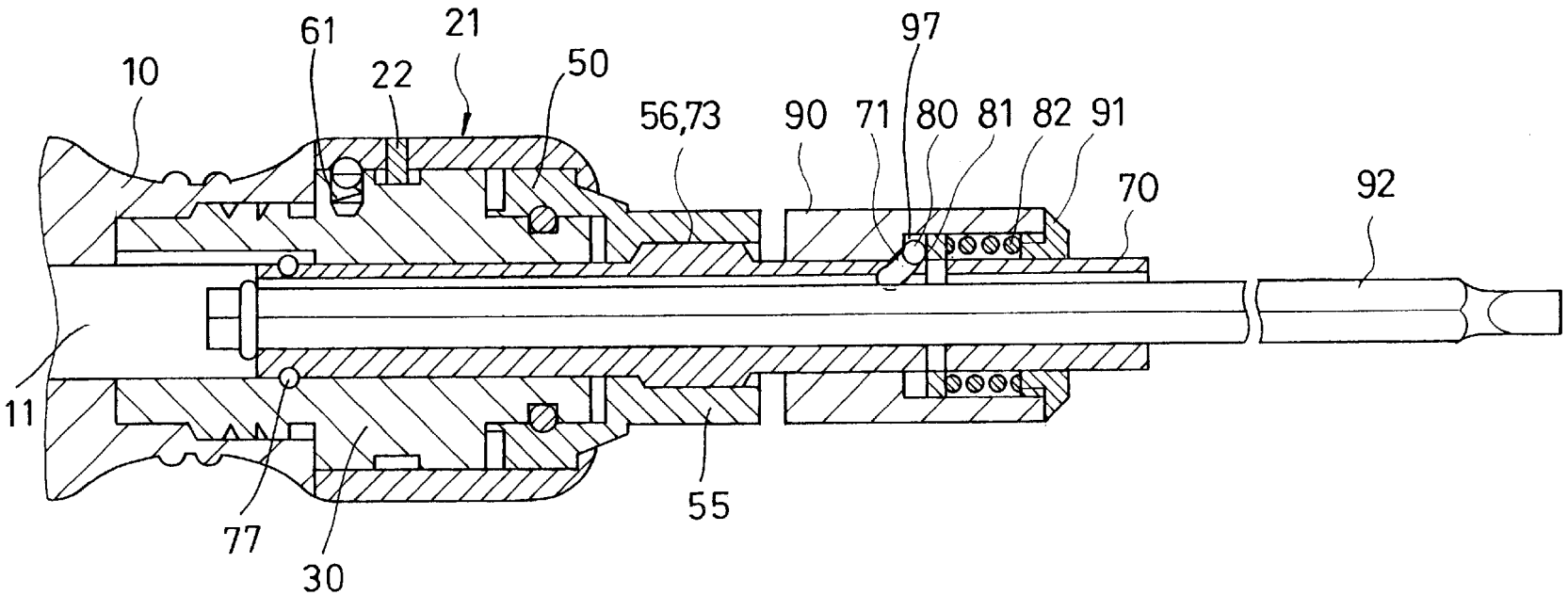
FIG. 6 is an enlarged partial cross sectional view similar to FIG. 3, illustrating the operation of the ratchet tool.

As shown in FIGS. 1, 3, 6, the driving stem 70 includes a rear end or an inner end having an annular groove 74 formed therein for receiving a clamping ring 77 therein which may engage with the extension 32 of the housing 30 for limiting the relative movement between the driving stem 70 and the housing 30, and for preventing the driving stem 70 from being disengaged from the housing 30. The driving stem 70 may be engaged into the housing 30 from the hole 11 of the handle 10 and from the rear end of the handle 10. A cover 17 may be threaded to the rear end of the handle 10 for enclosing the rear portion of the hole 11 of the handle 10 and for retaining the other elements within the handle 10.

The driving stem 70 includes an engaging hole 72 formed therein for changeably receiving the tool members 92, such as the tool bits, or the fasteners or the tool shanks (92), or the like therein, such that the driving stem 70 may be selectively used to drive various kinds of or different tool bits or fasteners or tool shanks. The tool shanks or the tool members 92 may each include one or more outer surfaces 93 having a coarse or knurled surface 94 formed therein (FIG. 1). The driving stem 70 includes a guide passage 71 formed therein and being a U-shaped slot flush on the driving stem 70, and communicating with the engaging hole 72 thereof.

A rod 80 is slidably received in the guide passage 71 of the driving stem 70 and perpendicular to the driving stem 70 and has a middle portion movable inward of the engaging hole 72 of the driving stem 70 (FIGS. 3, 6) for engaging with and for securing the driving shanks 92 to the driving stem 72. The rod 80 preferably also includes a coarse or knurled surface formed on the outer peripheral portion thereof for engaging with the corresponding knurled surface 94 of the tool member 92 and for solidly securing the tool member 92 to the driving stem 72. A washer or a ring 81 is slidably engaged on the driving stem 70 and engaged with the ends of the rod 80, and a spring 82 is also engaged on the driving stem 70 and engaged with the ring 81 for biasing the rod 80 inward of the engaging hole 72 of the driving stem 70 and for engaging with and for securing the driving shanks 92 to the driving stem 72. An actuating sleeve 90 is rotatably and slidably engaged on the front portion of the driving stem 70 and includes a peripheral shoulder 97 formed and provided therein for engaging with the ends of the rod 80 and for moving the rod 80 away from the driving shanks 92 against the spring 82. The ring 81 and the spring 82 are received in the actuating sleeve 90. A cap 91 is engaged on the driving stem 70 and secured to the front portion of the actuating sleeve 90 with such as a threaded engagement, and engaged with the spring 82, for retaining the spring 82 and the ring 81 within the actuating sleeve 90.

In operation, the rod 80 may be biased inward of the engaging hole 72 of the driving stem 70 to engage with the driving shank 92 and to detachably secure the driving shank 92 to the driving stem 70, such that various kinds of or different driving shanks 92 may be detachably and changeably secured to the driving stem 70 with the spring-biased rod 80, and such that the driving stem 70 of the ratchet tool may be used to drive various kinds of tool shanks or tool members or fasteners.

Accordingly, the ratchet tool includes one or more longitudinal pawls for solidly engaging with the peripheral gear in order to increase the rotational driving torque to the driven fasteners, and one or more driving stems that may be changed with each other for facilitating the operation of the ratchet tool.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet tool comprising:

a housing including a pair of longitudinal channels formed therein, a seat rotatably secured to said housing and including a first end facing toward said housing and having a plurality of teeth formed therein, said seat including a cylindrical member extended therefrom and having an aperture formed therein, a driving stem engaged in said aperture of said cylindrical member, said driving stem including an engaging hole formed therein, a tool member received in said engaging hole of said driving stem, means for detachably securing said tool member to said driving stem, said detachably securing means including a guide passage formed in said driving stem and communicating with said engaging hole of said driving stem, a rod slidably received in said guide passage of said driving stem, and a rod biasing means for biasing said rod to move inward of said engaging hole of said driving stem and to engage with said tool member, for detachably securing said tool member to said driving stem, and said guide passage of said driving stem being a U-shaped slot flush on said driving stem, to perpendicularly receive said rod in said guide passage of said driving stem, a pair of pawls is slidably engaged in said longitudinal channels of said housing respectively, means for biasing said pawls is to move longitudinally relative to said housing to engage with said teeth of said seat, and means for selectively disengaging said pawls from said teeth of said seat to control a rotational direction of said seat by said housing.

2. The ratchet tool according to claim 1, wherein said seat includes an orifice formed in said first end thereof, said housing includes a barrel rotatably secured in said orifice of said seat.

3. The ratchet tool according to claim 1, wherein said housing includes an outer peripheral portion having a passageway formed therein and communicating with said channels of said housing, said selectively disengaging means includes an actuator slidably received in said passageway of said housing and rotatable to engage with either of said pawls.

4. The ratchet tool according to claim 3, wherein said pawls each includes a notch formed therein, said actuator includes two ends engageable into said notches of said pawls.

5. The ratchet tool according to claim 4, wherein said ends of said actuator each includes an inclined surface formed therein for facilitating an engagement of said ends of said actuator into said notches of said pawls.

6. The ratchet tool according to claim 3, wherein said selectively disengaging means includes a control ferrule rotatably secured on said housing and having said actuator secured thereto for moving said actuator along said passageway of said housing.

7. The ratchet tool according to claim 6, wherein said selectively disengaging means includes a fastener for securing said actuator to said control ferrule and for allowing said actuator to be rotated by said control ferrule.

8. The ratchet tool according to claim 6 further comprising means for selectively securing said control ferrule to said housing at a selected angular position.

9. The ratchet tool according to claim 1, wherein said rod biasing means includes a spring engaged on said driving stem and engaged with said rod for biasing said rod to engage with said tool member.

10. The ratchet tool according to claim 9, wherein said rod biasing means further includes a ring engaged between said rod and said spring.

11. The ratchet tool according to claim 9, wherein said rod biasing means further includes an actuating sleeve engaged on said driving stem and having a peripheral shoulder provided therein for engaging with said rod and for moving said rod inward of said engaging hole of said driving stem.

12. The ratchet tool according to claim 11, wherein said rod biasing means further includes a cap engaged on said driving stem and secured to said actuating sleeve and engaged with said spring for retaining said spring within said actuating sleeve.

* * * * *